US007195462B2

(12) United States Patent
Nybo et al.

(10) Patent No.: US 7,195,462 B2
(45) Date of Patent: Mar. 27, 2007

(54) METHOD FOR CONTROLLING SEVERAL PUMPS

(75) Inventors: Peter Jungklas Nybo, Randers (DK); Lasse Ilves, Helsinki (FI); Heikki Yli-Korpela, Vantaa (FI)

(73) Assignee: Grundfos a/s (DK)

( * ) Notice: Subject to any disclaimer, the term of this patent is extended or adjusted under 35 U.S.C. 154(b) by 298 days.

(21) Appl. No.: 10/646,241

(22) Filed: Aug. 22, 2003

(65) Prior Publication Data

US 2004/0071554 A1 Apr. 15, 2004

(30) Foreign Application Priority Data

Aug. 23, 2002 (EP) ..... 02018830

(51) Int. Cl.
*F04B 49/00* (2006.01)

(52) U.S. Cl. ..... 417/53

(58) Field of Classification Search ..... 417/3, 417/4, 53, 36, 38, 426
See application file for complete search history.

(56) References Cited

U.S. PATENT DOCUMENTS

| | | | | |
|---|---|---|---|---|
| 3,741,683 | A * | 6/1973 | McTamaney et al. | 417/7 |
| 3,744,932 | A * | 7/1973 | Prevett | 417/8 |
| 4,222,711 | A * | 9/1980 | Mayer | 417/7 |
| 4,437,811 | A | 3/1984 | Iwata et al. | |
| 5,449,274 | A | 9/1995 | Kochan, Jr. | |

FOREIGN PATENT DOCUMENTS

| | | |
|---|---|---|
| DE | 199 27 365 A1 | 2/2000 |
| EP | 1 216 736 A1 | 6/2002 |
| JP | 06241191 | 8/1994 |

* cited by examiner

*Primary Examiner*—Anthony D. Stashick
*Assistant Examiner*—Samuel E. Belt
(74) *Attorney, Agent, or Firm*—Jacox, Meckstroth & Jenkins

(57) ABSTRACT

The invention relates to a method for controlling several pumps in a pump sump, with which each pump comprises a switch which switches on the pump and each pump after its running is first blocked and depending on the running of the further pumps in the pump sump is released again. The invention further relates to a pump for carrying out this method.

27 Claims, 1 Drawing Sheet

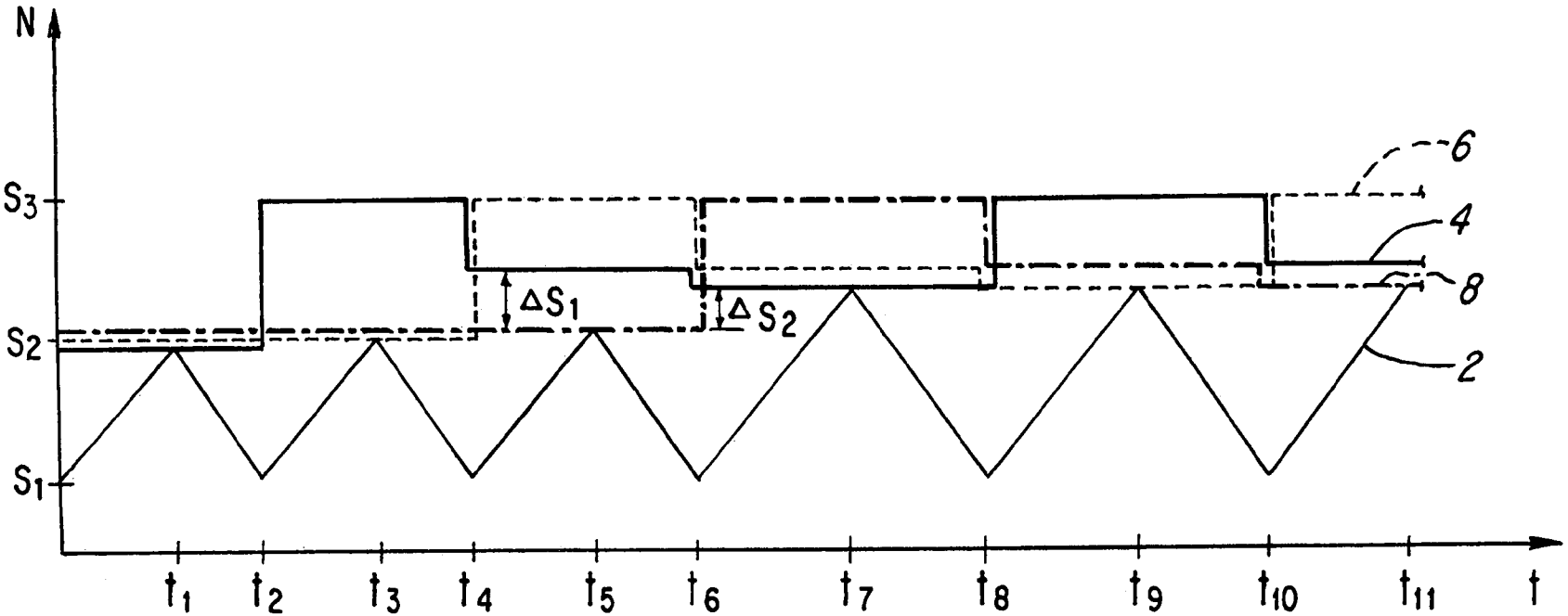
N
S3
S2
S1
t1
t2
t3
t4
t5
t6
t7
t8
t9
t10
t11
t
ΔS1
ΔS2
2
4
6
8

METHOD FOR CONTROLLING SEVERAL PUMPS

BACKGROUND OF THE INVENTION

The invention relates to a method for controlling several pumps as well as a correspondingly designed pump.

There are known pumps, in particular submersible pumps which are applied in pump sumps in order to pump away the fluid collected in the pump sump given a predefined fluid level. With such a pump sump one often uses several pumps. With the application of several pumps it is to be ensured that the pumps are uniformly operated in capacity so that the pumps also wear uniformly. The alternating activation of the individual pumps requires a central control which alternately switches the pumps on and off. The installation of such a central control renders the assembly and operation of the pumps more difficult.

From DE 199 27 365 C2 there is known a control of several pumps in a common pump sump, according to which even when achieving a predefined switching threshold is not switched on if it is not the turn of the respective pump in alternating operation of several pumps. This control requires additional signals or information on the number of applied pumps in order to be able to set an alternating operation. Furthermore when starting for the first time one requires an increased control and setting effort in order to set the alternating operation with a certain number of pumps. Furthermore the fact that a pump which is not next in line is not switched on even when achieving its switching threshold leads to problems when the respective pump which is next in line in alternating operation fails.

BRIEF SUMMARY OF THE INVENTION

It is therefore the object to provide a method for controlling several pumps in a pump sump as well as a correspondingly designed pump, which require no additional control and permits a simplified and failure-secure control of an alternating operation of several pumps.

This object is achieved by a method for controlling one or more pumps in a pump sump with which each pump comprises a signal generator which switches on the pump, and each pump subsequent to its running if firstly automatically blocked by changing its switching value and depending on the running of the further pumps in the pump sump is released again.

The object is further achieved by a pump with a signal generator and a control means for activating the pump, wherein the control means comprises a means for detecting the operation of further pumps in the same pump housing, a blocking function which blocks the pump by changing its switching value and a release function which releases the pump again depending on the operation of further pumps. Preferred embodiment forms are to be deduced from the accompanying dependent claims.

According to the method according to the invention, several pumps are applied in a preferably common pump sump. In the context of the method according to the invention such a pump sump may consist of several pump sumps which communicate with one another or are connected to one another. Each of the pumps applied in the pump sump comprises a signal generator which switches on the pump. With this it is preferably the case of a switch which activates the pump given a predefined fluid level or fluid level threshold value. After their operation or running, each pump is blocked firstly independently, i. e. without communication with further pumps or a central control, by way of changing the switching value of the pump, and later is released again depending on the running or operation of the further pumps in the pump sump. The switching value is the value at which the signal generator switches on the pump.

By way of changing the switching value of the pump after operations, one prevents the same pump from being directly activated when again reaching the initial switching value or the initial fluid level threshold value. Since the switching value of the pump is changed, with the next required pump procedure one of the further pumps is activated whose switching value is reached earlier than the changed switching value. After this, this pump too is blocked by way of changing its switching value so that with the next required pumping procedure the next one of the pumps is activated and so forth. The individual pumps later are again released by a renewed changing of the switching value so that they are then activated again when this is reached if all remaining pumps have likewise been run. Instead of blocking the pumps already after each running the control may also be set up so that the pumps run several times after one another, e. g. twice before they are blocked. By way of this control one may succeed in operating the pumps alternately and burdening them uniformly.

At the same time the pumps do not communicate with one another and are not connected to one another by way of a central control means. Rather the individual pumps comprise control means which are independent of one another. Merely by way of the intelligent control of each individual pump one succeeds in running the pumps alternately despite the fact that they do not communicate with one another and are not centrally controlled. Since for controlling the several pumps one requires no connection between the pumps and no central control means, the application and assembly of such pumps is extremely simple. The pumps merely need to be applied into a pump sump without the pumps for example having to be connected to one another for example by way of control conduits. Subsequently the alternating operation of the individual pumps is automatically set, without further setting work being required. At the same time the control of the individual pumps is preferably designed such that each pump is also capable of functioning alone, i. e. may be operated in a pump sump without further pumps. In this manner one creates a universally applicable pump.

Preferably the blocking of the pump is effected in that for each pump after its operation the fluid level threshold value at which the pump is started, firstly is increased proceeding from an initial threshold value and is reduced again depending on the running of the further pumps in the pump sumps. The initial threshold value is that switching value or threshold value at which the pump is activated in its initial condition or delivered condition. I.e. if the fluid level increases to the level of the initial threshold value the pump is set into operation in order to pump away the fluid. According to the invention after operation of the pump the fluid level threshold value, i. e. the switching value is increased so that the pump is no longer activated on reaching the initial threshold value. This has the effect that on reaching the initial threshold value firstly a further pump whose fluid level threshold value has not yet been increased is set into operation. The fluid level threshold value is later reduced again depending on the operation of the further pumps arranged in the pump sump, so that the first pump is also set into operation if the other pumps have run. If the pumps are applied for the first time in a pump sump, all pumps are set to the initial threshold value. Due to tolerances however not all pumps start with exactly the same fluid level. This has the effect that with a high probability one pump starts first. Since after operational start of one of the pumps the fluid level sinks, the other pumps are not started as long as the first started pump is in operation. By way of the fact that the blocking of the pump is effected by increasing the fluid level threshold value it is achieved that the pump is not completely blocked, but at any case is activated with a higher fluid level. This is important if more fluid subsequently runs into the pump sump than a single pump alone may pump away, another pump is defect or the pump alone is applied in the pump sump. The higher fluid level threshold value thus represents a reserve or emergency threshold value at which the pump in any case is activated.

Preferably the fluid level threshold value for each pump after the running of a further pump is reduced in steps by a predefined value. This has the effect that the fluid level threshold value is further reduced after each running of a further pump so that it again approaches the initial threshold value. By way of this stepped reduction of the fluid level threshold value the fluid level threshold value of each pump will again some time reach a value which is smaller than the fluid level threshold values of the remaining pumps so that on increase of the fluid level this first pump again is set in operation. By way of the cyclic increase and subsequent stepped reduction of the fluid threshold values it is achieved that the pumps are always alternately set into operation.

The reduction of the fluid level threshold value at the same time is effected preferably according to a geometric sequence. For example the value by which the actual fluid level threshold value lies above the initial threshold value may be halved after each running of a further pump or be reduced by another predefined factor. Preferably the reduction is effected in a manner such that the actual fluid level threshold value always lies above the initial threshold values so that a newly applied pump whose threshold value corresponds to the initial threshold value is always set into operation first.

It is further preferred for the fluid level threshold value after operation of a further pump in each case to be reduced to a level which depends on the number of previously run pumps. The setting or the reduction of the fluid level threshold value in this manner is adapted to the number of pumps arranged in the pump sump which are capable of operation and are operated alternately. One may thus ensure that the individual pumps are always operated alternately and are burdened uniformly.

The fluid level threshold value is preferably in each case reduced to a level which corresponds to $$x + \Delta x x \frac{1}{n}$$

wherein x corresponds to the initial threshold value; Δx the amount by which the fluid level threshold value is increased with respect to the initial threshold value, and n is the number of previously run pumps. This is a preferred control of the pumps with which the reduction of the fluid level threshold value is effected such that the fluid level threshold value after each running of a further pump further approximates the initial threshold value. The fluid level threshold reached on reduction however always lies above the initial threshold value, by which means it is achieved that if a further or new pump is applied into the pump sump, this has the lowest fluid level threshold value, specifically the initial threshold value and thus will run first. The stepped reduction further has the effect that of the pumps which have already run the respective earlier run pump has a lower fluid level threshold value than the later run pumps so that this pump is also firstly again set into operation. With this it is ensured that the individual pumps are always actuated cyclically in succession and thus are uniformly burdened.

For operating the method according to the invention each pump preferably comprises a means for detecting the number of pumps applied in operation in the pump sump. Pumps applied in operation means those pumps which are alternately activated in order to pump away fluid out of the pump sump. Defect pumps or one which are not to be activated for other reasons are not taken into account. The detection of the number of pumps applied in the pump sump may for example be effected by a user who at a suitable input means on each individual pump sets how many pumps additionally or how many pumps as a whole are applied in the pump sump. Preferably however each pump comprises a means which automatically detects how many further pumps are operated in the pump sump. By way of this one may achieve a very simple starting operation of the pumps since the pumps merely need to be applied into the pump sump or set, and no further setting-up or setting work is required.

Preferably each pump via a suitable sensor detects the course of the further pumps and at the same time the number of applied pumps. Since the pump may detect the operation of the further pumps, by way of a suitable counting means it may count how may pumps are successively operated.

Preferably in each pump there is provided a level sensor and in particular a pressure sensor. The level sensor on the one hand serves as a signal generator or switch for switching the pump on and/or off at certain fluid levels in the pump sump. Furthermore the level sensor may serve as a sensor for detecting the running or operation of further pumps in the pump sump. At the same time the level sensor detects the running of the further pumps in that it ascertains a reduction of the fluid level in the pump sump whilst the pump belonging to the sensor is simultaneously blocked or has a higher fluid level threshold value for activating the pump. By way of this the control means may ascertain that the fluid level is reduced by the operation of a further pump and in this manner count the number of further pumps in the pump sump. The level sensor is preferably designed as a pressure sensor. By way of the hydrostatic pressure which is detected by the pressure sensor one may determine the height of the liquid level above the pressure sensor.

With the method preferably each pump after its own running, i. e. after each individual running sets the value n for the number of pumps to n=1 and increases the value n after each running of a further pump by 1. In this manner the total number of the pumps operated in the pump sump may be determined and the reduction of the fluid level threshold value may be controlled accordingly.

For the case that a pump is operated alone in a pump sump with the control method according to the invention the control is preferably designed such that the pump automatically detects a condition in which no further pumps are arranged in the pump sump, and automatically lifts its blockage. This permits the universal application of the pump. The detection of the condition in which the pump is applied on its own may for example be effected in that by the control of the pump, by way of a suitable sensor, it is ascertained than the fluid level in the pump sump exceeds a threshold value at which a further pump would have to start, but that the level increases further. In this case the pump may lift the blockage again for example in that it reduces its fluid level threshold value again to the initial threshold value or starts straight away. In this manner it may be achieved for the case that the pump is applied on its own that the pumping away of the fluid from the pump sump is not effected firstly on reaching an emergency threshold value at which the fluid level threshold value for blocking the pump has been lifted.

The invention further relates to a pump which in particular is designed for operation according to the above-described method. The pump comprises a signal generator, preferably a level switch and a control means for activating and deactivating the pump. The control means comprises a means for detecting the operation of further pumps in the same pump sump, wherein pump sump itself is likewise to be understood as pump sumps connected to one another or communicating with one another. Furthermore the control means comprises a blocking function which blocks the pump by changing its switching value, and a release function which again releases the pump depending on the operation of the further pumps. At the same time the switching value is the value at which the signal generator switches on the pump. Such a pump may be operated according to the above method. After operation of the pump firstly the blocking function is activated by way of the control means, by which means a new activation of the pump by the signal generator at the initial switching value is firstly prevented or blocked. The means for detecting the operation of further pumps detects whether and preferably how many further pumps in the pump sump are operated after operation of the pumps. Depending on this information the release function may be activated by the control means which again releases the pump after the running of the further pumps by way of a renewed changing of the switching value. If several such pumps are applied in a pump sump the operation of the individual pumps is automatically set without interconnection and central control of the pumps such that the pumps are always operated alternately.

Preferably the control means comprises a means for detecting the number of pumps in a pump sump, wherein it may be the case of a common pump sump or several pump sumps communicating with one another. By way of the fact that the control means detects how many further pumps are in operation it may control the release function such that the associated pump is released again after the other pumps have run. In this manner one may always alternately operate several such pumps.

The switch is preferably a level switch and in particular a pressure sensor. Such a level switch activates and deactivates the pump with predefined fluid levels, i. e., switching values, in the pump sump. The level switch may for example be designed as a pressure sensor which detects the hydrostatic pressure at the height of the pressure sensor. From this value one may determine the height of the fluid level above the pressure sensor.

The blocking function is preferably designed such that it increases the threshold value of the level switch. The threshold value or switching value of the level switch corresponds to the fluid level with which the pump is to be set in operation. If after the running of the pump the threshold value is increased the pump will only assume its operation at a corresponding higher fluid level. If then further pumps are applied in the pump sump and these have a corresponding lower threshold value, firstly these pumps are operated. With this the first pump is practically blocked. The release function preferably reduces the threshold value again so that after a phase of the blocking the threshold value again assumes such a low level that the pump when reaching the corresponding fluid level is activated before the further pumps located in the pump sump. The control means is preferably designed in a manner such that the threshold value is steps in each case after detecting the running of a further pump is reduced by a predefined value so that it again approaches the initial threshold value in a stepped manner. Depending on the number of applied pumps the threshold value at the same time will sooner or later fall below the threshold values of the other applied pumps so that the pump is no longer blocked but on reaching the corresponding fluid level is activated again. The measure by which the threshold value is reduced is preferably dependent on the number of applied pumps.

The means for detecting the operation of further pumps in a pump sump preferably accesses signals of the level switch. The level switch detects a reduction of the fluid level in the pump sump independently of whether its own, i. e., associated pump or another pump is responsible for the reduction of the fluid level. If then the individual pump is not in operation the control means by way of the reduction in the fluid level may detect that a further pump in the pump sump is in operation and reduces the fluid level in the pump sump. In this manner one may detect the operation of further pumps in the pump sump and the number of applied pumps may be counted.

Preferably the whole control means is integrated into the pump or the pump housing. The complete control means is preferably located in the housing of a submersible pump. The pump need subsequently to only be applied or suspended into the pump sump and connected to an electricity supply. The connection to a central control means or connection to the further applied pumps is not necessary. If then a plurality of such pumps provided with the same control are applied, due to the intelligent control of each pump the operation of the individual pumps will be set such that the individual pumps are operated alternately. This setting is effected automatically without the pumps communicating directly with one another.

Other objects and advantages of the invention will be apparent from the following description, the accompanying drawings and the appended claims.

BRIEF DESCRIPTION OF THE DRAWINGS

The invention is hereinafter described by way of example with the attached diagram.

DETAILED DESCRIPTION OF THE INVENTION

In the attached diagram there is schematically shown the course of the fluid level N in a pump sump as well as the threshold values of the applied pumps over the time t. The lower unbroken line 2 represents the fluid level in the pump sump over the time t. The unbroken line 4, the dashed line 6 as well as dot-dashed line 8 in each case symbolise the fluid level threshold value of a pump at which the respective pump is activated. In its basic condition each pump has three fluid level threshold values $S_1$, $S_2$ and $S_3$. At the same time the threshold value $S_2$ corresponds to an initial threshold value which is set in the basic or delivered condition of the pump and when it is reached the pump is activated via a level sensor. The threshold value $S_1$ is the threshold value which when reached deactivates the pump. The threshold value $S_3$ represents a second start threshold value at which when reached each pump is in any case activated, independently of the remaining control. $S_3$ is thus an emergency start value at which the pumps in any case are activated, for example if the supply of fluid in the pump is so large that an individual pump is no longer sufficient to pump away the fluid.

Hereinafter the control of three pumps over a temporal course in a common pump sump is described. A common pump sump may at the same time be seen as an arrangement of several pump sumps which for example communicate with one another via tube conduits. At the beginning all three applied pumps are set in the condition of delivery, i. e. the fluid level threshold value is set to the initial threshold value $S_2$. Due to tolerances and height differences on application into the pump sump however with a large probability not all initial threshold values lie exactly at the level $S_2$. With the rising of the fluid level in the pump sump thus firstly the fluid level threshold value of one of the three pumps, in the shown example that pump which is represented by the unbroken line 4 is reached. On reaching the fluid level threshold value 4 at the point in time $t_1$ the corresponding pump is set in operation and the fluid level 2 in the pump sump falls. The fluid level threshold value of the two further pumps is thus firstly not reached so that these pumps are not set into operation. At the point in time $t_2$ the fluid level 2 reaches the threshold value $S_1$ at which the first pump is set out of operation. At the same time the fluid level threshold value of the first pump is set by the control to the value $S_3$ and thus firstly blocks the first pump. Furthermore the control of the first pump sets its counter n for the number of pumps arranged in the pump sump in operation to the value n=1.

In this condition the fluid level threshold values of the two further pumps continue to correspond to the initial threshold value. The fluid level 2 in the pump sump now increases again until reaching the fluid level threshold value of the second pump which is shown in the diagram by the dashed line 6. On reaching this threshold value the second pump is set into operation (at the point in time $t_3$) and the fluid level reduces again until the threshold value $S_1$ is reached at the point in time $t_4$ and the second pump is switched off. During the running of the second pump the first pump (unbroken line 4) detects that the fluid level 2 in the pump sump reduces whilst it itself is not in operation. If now by operation of the second pump at the point in time $t_4$ the fluid level 2 reaches the threshold value $S_1$ and the first pump registers this, its control increases the counter n by 1 in the present case thus to n=2. The first pump simultaneously reduces the fluid level threshold value of the first pump. With this it reduces the threshold value to a value above the initial threshold value. The new fluid level threshold value lies above the initial threshold value $S_2$ by $\Delta S_1$, therein $$\Delta S_1 = (S_3 - S_2) \times \frac{1}{n}$$

The new fluid level threshold value is thus $S_2+\Delta S_1$.

The second pump after its running at the point in time $t_4$ sets the fluid level threshold value of the second pump (dashed line 6) to the threshold value $S_3$. If now after the point in time $t_4$ the fluid level 2 in the pump sump rises again and reaches the initial threshold value $S_2$, the third pump is activated at the point in time $t_5$, whose fluid level threshold value (dot-dashed line 8) again corresponds to the initial threshold value. The third pump now pumps fluid for so long until the fluid level 2 has reached the threshold value $S_1$ at the point in time $t_6$. If the fluid level 2 reaches the threshold value $S_1$, the third pump is switched off at the point in time $t_6$. Simultaneously the control of the third pump sets the fluid level threshold value of the third pump to the value $S_3$, wherein the third pump is blocked as previously the first and the second pump. Furthermore the control of the third pump according to the preceding pumps sets its counter n for the number of pumps to the value n=1. During the running of the third pump between the points in time $t_5$ and $t_6$, as previously described, the first and second pumps detect that the fluid level 2 changes by operation of a further pump. The controls may detect this in that the fluid level 2 changes before the respective fluid level threshold value of its own pump has been reached. This causes the control of the first pump at the point in time $t_6$ to increase the counter n for the number of pumps again by 1 to the value n=3. Accordingly the control of the second pump increases its counter n to the value n=2. The control of the first pump again reduces the fluid level threshold value at the point in time $t_6$ again to the value $$S_2 + (S_3 - S_2) \times \frac{1}{n}$$

Thus the new fluid level threshold value of the first pump is $S_2+\Delta S_2$, wherein $\Delta S_2=(S_3-S_2)\times 1/n$.

The control of the second pump, like the control of the first pump at the point in time $t_4$, reduces the fluid level threshold value of the second pump to the value $\Delta S_1$ above the initial threshold value $S_2$. Thus at the point in time $t_6$ the fluid level threshold value of the first pump (unbroken line 4) is the lowest so that with a further increase of the fluid level 2 in the pump sump firstly at the point in time $t_7$ the fluid level threshold value of the first pump is reached and the first pump is again set into operation. The first pump then again reduces the fluid level 2, until at the point in time $t_8$ the threshold value $S_1$ is reached and the first pump is switched off. At this point in time the control means of the first pump sets the counter for the number of pumps again to the value n=1 and increases the fluid level threshold value of the first pump again to the value $S_3$. Simultaneously the control of the second pump increases the counter n to the value n=3 and the control of the third pump increases its counter n to the value n=2. Accordingly the fluid level threshold value of the second pump is reduced to the value $S_2+\Delta S_2$ and the fluid level threshold value of the third pump to the value $S_2+\Delta S_1$. Thus at the point in time $t_8$ the fluid level threshold value of the second pump is the lowest so that this after a renewed increase of the fluid level 2 at the point in time $t_9$ is activated as the next pump. According to this, the method according to the invention runs cyclically further, wherein the individual pumps, i. e. in the described example the pumps 1, 2 and 3 are always activated alternately in succession. This leads to a uniform burdening of the pumps.

Although the example has been described for three pumps, any other number of pumps is possible. The control of the individual pumps is identical, wherein according to the method according to the invention, independently of the number of pumps and without linking the individual pumps an alternating operation of the pumps sets in, irrespective of how many pumps are arranged in the pump sump.

If a further or new pump is additionally applied into the pump sump, its fluid level threshold value again has the initial threshold value S2 which is always smaller than the fluid level threshold value of the already operated pumps. This results from the fact that the amount is $$\Delta S_{n-1} = (S_3 - S_2)\frac{1}{n}$$

wherein n corresponds to the number of previously run pumps. Thus on applying a new pump this pump is always firstly activated with an increase of the fluid level 2. The above described cycle then again automatically sets in.

Accordingly the pumps react if one of the pumps should fail: if for example at the point in time $t_6$ the first pump should fail, the next pump which is activated with an increase of the fluid level 2 is the second pump, since this has the next highest fluid level threshold value. Subsequently according to the method according to the invention an alternating operation of the second and third pump automatically sets in. The method according to the invention by way of an intelligent control specific to the pump ensures that with a failure of a pump or with the addition of a further pump an alternating operation of the pumps in the pump sump automatically sets in. At the same time there is no direct communication between the pumps or a common central control of the pumps. Each pump represents a unit closed per se which merely need to be connected to a fluid conduit and a current supply. The control means and the switch of each pump, preferably a pressure sensor are preferably integrated into the pump housing so that the individual pumps may be simply suspended into a pump sump as with conventional submersible pumps.

The pump according to the invention may also be applied on its own in a pump sump. For this the control of the pump is preferably designed such that it recognises this condition of application of the individual pump. This may for example be effected in that the fluid level in the pump sump after the running of the pump increases beyond the value $$S_2 + \frac{(S_3 - S_2)}{2}$$

This is the fluid level threshold value at which a further pump in the pump sump must start. If the fluid level rises beyond this value this is a sign that no further pump is present. In this case the control of the single present pump may reduce its fluid level threshold value at which the pump is activated again to the initial threshold value $S_2$ or to the value $$S_2 + \frac{(S_3 - S_2)}{2}$$

This has the advantage that the value $S_2$ remains as an emergency start threshold value, wherein the corresponding fluid level in the normal case should not be reached. On reaching $S_2$ every present pump is in any case activated or switched on independently of the remaining control method.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method for controlling one or more pumps in a pump sump with which each pump comprises a signal generator which switches on the pump, and each pump subsequent to its running is firstly automatically blocked by changing its switching value at which the pump is switched on by the signal generator from an initial switching value to a second switching value so that the same pump is prevented from being directly activated when again reaching said initial switching value, and depending on the running of the further pumps in the pump sump is released again.

2. A method according to claim 1, wherein each pump comprises means for detecting a number of pumps applied in operation in the pump sump.

3. A method according to claim 2, wherein each pump by way of a sensor detects the running of a further pump and with this detects said number of applied pumps.

4. A method according to claim 1, wherein in each pump there is provided a level sensor.

5. The method as recited in claim 4, wherein said level sensor is a pressure sensor.

6. A method for controlling one or more pumps in a pump sump with which each pump comprises a signal generator which switches on the pump, and each pump subsequent to its running is firstly automatically blocked by changing its switching value at which the pump is switched on by the signal generator so that the same pump is prevented from being directly activated when again reaching said initial switching value, and depending on the running of the further pumps in the pump sump is released again, wherein for each pump subsequent to its operation a fluid level threshold value at which the pump is started is firstly increased proceeding from an initial threshold value and depending on the running of the further pumps in the pump sump is reduced again.

7. A method for controlling one or more pumps in a pump sump with which each pump comprises a signal generator which switches on the pump, and each pump subsequent to its running is firstly automatically blocked by changing its switching value at which the pump is switched on by the signal generator so that the same pump is prevented from being directly activated when again reaching the initial switching value, and depending on the running of the further pumps in the pump sump is released again, wherein a fluid level threshold value for each pump is reduced in steps by a predefined value after the running of a further pump.

8. A method according to claim 7, wherein the reduction of said fluid level threshold value is effected according to a geometric sequence.

9. A method according to claim 7, wherein said fluid level threshold value after the operation of a further pump is in each case reduced to a level which is dependent on the number of the previously run pumps.

10. A method for controlling one or more pumps in a pump sump with which each pump comprises a signal generator which switches on the pump, and each pump subsequent to its running is firstly automatically blocked by changing its switching value at which the pump is switched on by the signal generator so that the same pump is prevented from being directly activated when again reaching the initial switching value, and depending on the running of the further pumps in the pump sump is released again, wherein a fluid level threshold value for each pump is reduced in steps by a predefined value after the running of a further pump, wherein said fluid level threshold value after the operation of a further pump is in each case reduced to a level which is dependent on the number of the previously run pumps; wherein said fluid level threshold value in each case is reduced to a level which corresponds to $$x + \Delta x \cdot \frac{1}{n}$$

wherein x corresponds to the initial threshold value, Δx the amount by which said fluid level threshold value has been increased with respect to the initial threshold value, and n the number of previously run pumps.

11. A method for controlling one or more pumps in a pump sump with which each pump comprises a signal generator which switches on the pump, and each pump subsequent to its running is firstly automatically blocked by changing its switching value at which the pump is switched on by the signal generator so that the same pump is prevented from being directly activated when again reaching said initial switching value, and depending on the running of the further pumps in the pump sump is released again, wherein each pump after its

12. A method for controlling one or more pumps in a pump sump with which each pump comprises a signal generator which switches on the pump, and each pump subsequent to its running is firstly automatically blocked by changing its switching value at which the pump is switched on by the signal generator so that the same pump is prevented from being directly activated when again reaching said initial switching value, and depending on the running of the further pumps in the pump sump is released again, wherein the pump automatically detects a condition in which no further pumps are arranged in the pump sump, and automatically lifts their blocking.

13. A pump comprising a signal generator and control means for activating the pump, wherein the control means comprises a detector for detecting the operation of at least one other pump in the same pump sump, a blocking function which blocks the pump by changing its switching value from an initial switching value to a second switching value at which the pump is switched on so that the same pump is prevented from being directly activated when again reaching the initial switching value, and a release function which releases the pump again depending on the operation of further pumps in the sump pump.

14. A pump according to claim 13, wherein the control means comprises means for detecting the number of pumps in a pump sump.

15. A pump according to claim 13, wherein said pump comprises a level switch.

16. A pump according to claim 15, wherein said blocking function increases a threshold value of said level switch and the release function reduces said threshold value of said level switch.

17. A pump according to claim 16, wherein the control means is designed in a manner such that the threshold value in each case after detecting the running of a further pump is reduced in steps by a predefined value.

18. A pump according to claim 15, wherein the means for detecting the operation of the further pumps in said pump sump accesses signals of the level switch.

19. The pump as recited in claim 15, wherein said level switch is a pressure sensor.

20. A pump according to claim 13, wherein the control means is integrated into said pump.

21. A pump with a signal generator and a control for activating a pump with an initial switching value, wherein said control comprises a detector for detecting the operation of at least one pump in the same pump sump, a blocking function which blocks the pump by changing its switching value from said initial switching value to a second value and a release function which changes said second switching value to release the pump in response to the operation of further pumps.

22. The pump according to claim 21, wherein said control comprises a detector for detecting a number of pumps in a pump sump.

23. The pump according to claim 21, wherein said pump comprises a level switch comprising a pressure sensor.

24. The pump according to claim 23 wherein said detector for detecting the operation of the further pumps in a pump sump is responsive to signals of the level switch.

25. A pump with a signal generator and a control for activating a pump with an initial switching value, wherein said control comprises a detector for detecting the operation of at least one pump in the same pump sump, a blocking function which blocks the pump by changing its switching value from said initial switching value to a second value and a release function which changes said second switching value to release the pump in response to the operation of further pumps;

wherein said pump comprises a level switch comprising a pressure sensor; and wherein said blocking function increases a threshold value of said level switch and the release function reduces the threshold value of said level switch.

26. A pump with a signal generator and a control for activating a pump with an initial switching value, wherein said control comprises a detector for detecting the operation of at least one pump in the same pump sump, a blocking function which blocks the pump by changing its switching value from said initial switching value to a second value and a release function which changes said second switching value to release the pump in response to the operation of further pumps;

wherein said pump comprises a level switch comprising a pressure sensor;

wherein said blocking function increases a threshold value of said level switch and the release function reduces the threshold value of said level switch; and wherein said control is designed in a manner such that said threshold value in each case after detecting the running of a further pump is reduced in steps by a predetermined value.

27. A pump with a signal generator and a control for activating a pump with an initial switching value, wherein said control comprises a detector for detecting the operation of at least one pump in the same pump sump, a blocking function which blocks the pump by changing its switching value from said initial switching value to a second value and a release function which changes said second switching value to release the pump in response to the operation of further pumps;

wherein said control is integrated into the pump.

* * * * *